US007267229B2

(12) United States Patent
Chen

(10) Patent No.: US 7,267,229 B2
(45) Date of Patent: Sep. 11, 2007

(54) FOLDABLE CONTAINER DEVICE

(76) Inventor: Cheng Shun Chen, P.O. Box 63-298, Taichung 40699 (TW)

( * ) Notice: Subject to any disclaimer, the term of this patent is extended or adjusted under 35 U.S.C. 154(b) by 483 days.

(21) Appl. No.: 10/986,055

(22) Filed: Nov. 12, 2004

(65) Prior Publication Data

US 2006/0102517 A1 May 18, 2006

(51) Int. Cl.
*B65D 19/00* (2006.01)

(52) U.S. Cl. ..... 206/600; 206/386; 220/4.33; 220/4.28

(58) Field of Classification Search ..... 220/1.5, 220/4.28, 4.31, 4.33, 7; 206/386, 577, 600; 108/55.1

See application file for complete search history.

(56) References Cited

U.S. PATENT DOCUMENTS 3,955,702 A * 5/1976 Lundy ..... 220/4.28
5,031,794 A * 7/1991 Wezenberg ..... 220/4.28
5,813,738 A 9/1998 Cheng ..... 312/263
5,873,480 A * 2/1999 Wells, Jr. ..... 220/4.02
5,996,828 A 12/1999 Cheyn ..... 220/4.33
6,036,041 A 3/2000 Chern ..... 220/6
6,832,580 B2 * 12/2004 Marchioro ..... 119/452
2004/0232145 A1 * 11/2004 Antal et al. ..... 220/4.33

* cited by examiner

*Primary Examiner*—David T. Fidei
(74) *Attorney, Agent, or Firm*—Charles E. Baxley

(57) ABSTRACT

A container device includes a skeleton having four vertical posts and four lower and four upper beams to be secured between end portions of the posts. Each of the posts includes a slot formed in one side and a groove in the other side of each of the end portions. A number of corner couplers each includes three extensions perpendicular to each other, for engaging into open ends of the beams and the posts. A number of insert panels are engaged into the end portions of the posts via the grooves of the posts and each includes a screw hole. A number of fasteners are engaged into the corner couplers, and threaded with the screw holes of the insert panels to secure the corner couplers and the beams and the posts together, and to form a parallelepiped container.

9 Claims, 6 Drawing Sheets

FOLDABLE CONTAINER DEVICE

BACKGROUND OF THE INVENTION

1. Field of the Invention

The present invention relates to a foldable container device, and more particularly to a container device which may be disassemble to a compact storing configuration that is excellent for transportation and storing purposes, and which includes a number of sustaining corner members to reinforce the corner areas of the container device and to prevent the container device from collapsing.

2. Description of the Prior Art

Typical container devices comprise a substantially cubic or parallelepiped structure having a number of plates or beams to be secured or assembled together.

For example, U.S. Pat. No. 5,813,738 to Cheng discloses a furniture combination including a number of plates having corner areas to be secured or assembled together. However, the corner areas of the plates have no suitable sustaining corner members such that the corner areas of the plates may not be reinforced and such that the furniture combination may easily collapse.

U.S. Pat. No. 5,996,828 to Cheyn discloses a corner assembly for a box and including a number of corner coupler members engaged in or between the corner areas of the plates, in order to solidly secure or couple the plates together, and to suitably sustain the corner areas of the plates, in order to prevent the box from collapsing.

However, the corner coupler members include a complicated configuration that may not be easily manufactured, and that includes a number of fins or blades extended therefrom such that the fins or blades may be easily bent or broken after use.

U.S. Pat. No. 6,036,041 to Chern discloses a foldable voting box including a number of panels or plates to be secured or assembled together. However, the corner areas of the plates also have no suitable sustaining corner members such that the corner areas of the plates may not be reinforced and such that the box may also easily collapse.

The present invention has arisen to mitigate and/or obviate the afore-described disadvantages of the conventional container devices.

SUMMARY OF THE INVENTION

The primary objective of the present invention is to provide a container device including a number of sustaining corner members to reinforce the corner areas of the container device and to prevent the container device from collapsing.

The other objective of the present invention is to provide a container device which may be disassemble to a compact storing configuration that is excellent for transportation and storing purposes.

In accordance with one aspect of the invention, there is provided a container device comprising a skeleton including four vertical posts to be disposed in four corner areas of the container device, each of the posts including two open end portions, and including a first side having a slot formed in each of the end portions thereof, and a second side having a groove formed in each of the end portions thereof and aligned with the slot thereof, four lateral lower beams and four lateral upper beams to be disposed and secured between the end portions of the posts respectively, and each including two open ends formed therein, a number of corner couplers disposed in the end portions of the posts respectively, and each including three extensions extended from X-axis, Y-axis and Z-axis thereof and perpendicular to each other, for engaging into the open ends of the beams and the open end portions of the posts respectively, each of the corner couplers including an orifice formed therein, a number of insert panels engaged into the end portions of the posts via the grooves of the posts respectively, and each including a screw hole formed therein and aligned with the orifice of the corner coupler respectively, and a number of fasteners engaged into the orifices of the corner couplers, and threaded with the screw holes of the insert panels respectively, to secure the corner couplers and the beams and the posts together, and to form a parallelepiped container structure.

The grooves of the posts include a width greater than that of the slots of the posts, and the insert panels each includes a protrusion extended therefrom to engage into the narrower slots of the posts and to allow the insert panels to be solidly engaged in the posts. The protrusions each includes a width smaller than that of the insert panels, to form at least one shoulder in the insert panel, and to engage with the posts. The insert panels include a length no greater than a thickness of the posts, to prevent the insert panels from being extended out of the posts.

The corner couplers each includes an enlarged opening formed in an outer portion thereof and communicating with the orifices thereof, to define a peripheral shoulder therein, and the fasteners each includes an enlarged head provided thereon and engaged with the peripheral shoulder of the corner coupler, to allow the fasteners to be engaged into and protected by the corner couplers.

A number of outer plates container device attached to outer peripheral portion and bottom portion of the skeleton. A cover container device pivotally attached to the skeleton with hinges, and including a handle for operating the cover.

One or more support runners may further be provided and attached to bottom of the container device, to form one or more spaces between the support runners, and for receiving forks of fork lifts. The support runners each includes two open ends, and two caps to enclose the open ends of the support runners.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
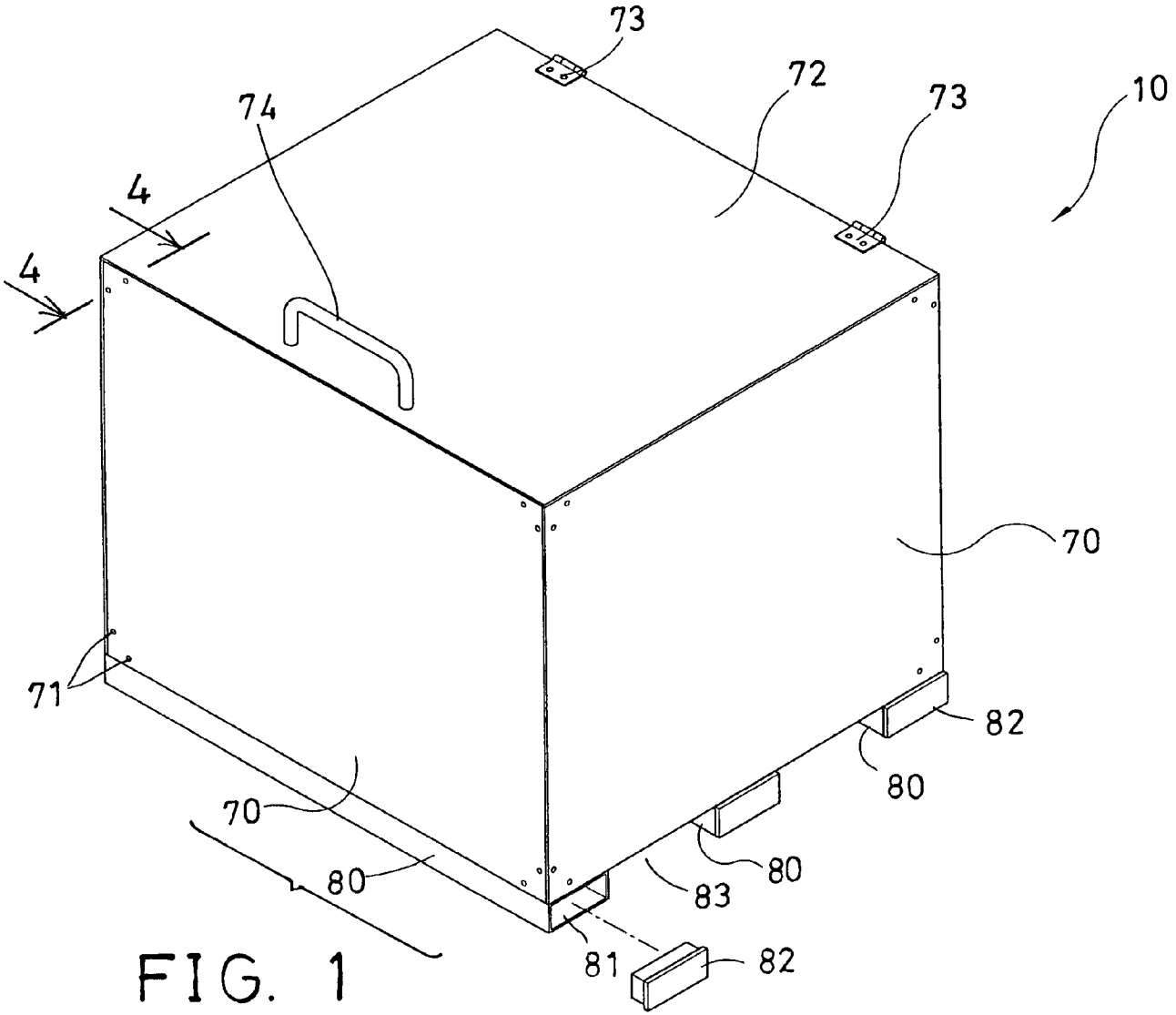
FIG. 1 is a perspective view of a container device in accordance with the present invention.
Figure 2:
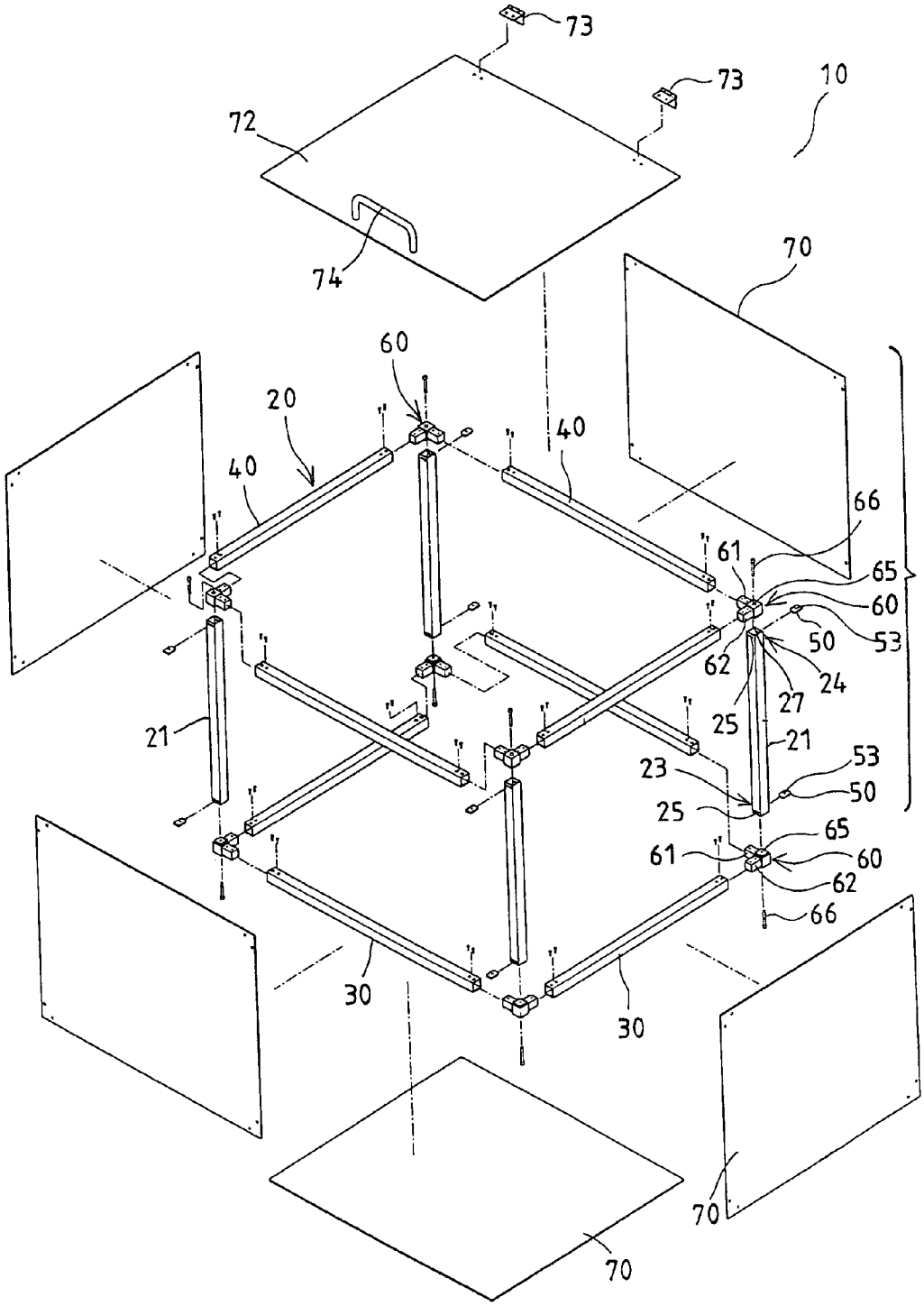
FIG. 2 is a partial exploded view of the container device.
Figure 3:
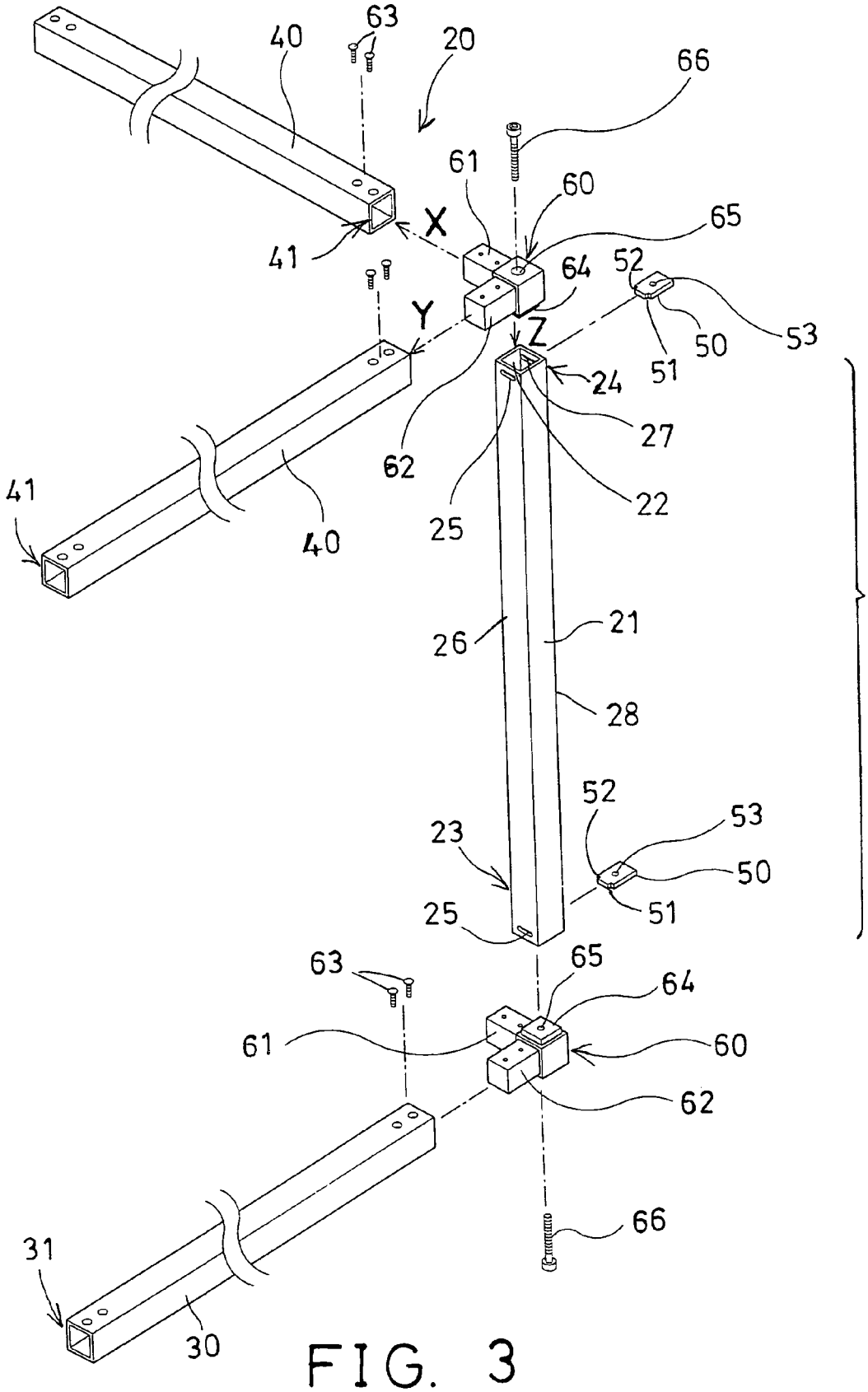
FIG. 3 is an enlarged partial exploded view of the container device.

Referring to the drawings, and initially to FIGS. 1-4, a container device 10 in accordance with the present invention comprises a skeleton 20 including four vertical posts 21 to be disposed in the four corner areas and arranged in a vertical or erected status. It is preferable that the posts 21 each includes a hollow space 22 formed therein and having two open end portions 23, 24.

Four lateral lower beams 30 are provided to be coupled or secured between the lower end portions 23 of the posts 21, and four lateral upper beams 40 are provided to be coupled or secured between the upper end portions 24 of the posts 21, and each of the beams 30, 40 includes two open ends 31, 41 formed therein. The beams 30, 40 may be coupled or secured between the end portions 23, 24 of the posts 21 with corner couplers 60, for example.

Each of the posts 21 includes a slot 25 formed in each of the end portions 23, 24 of one side, such as inner side 26 thereof, and a groove 27 formed in each of the end portions 23, 24 of the other side, such as outer side 28 thereof which is opposite the inner side 26 thereof. It is preferable that the grooves 27 are aligned with the slots 25 of the posts 21 and include a length or width greater than that of the slots 25 of the posts 21.

A number of insert panels 50 are provided to be engaged into the end portions 23, 24 of the posts 21 via the longer or wider grooves 27 of the posts 21, and each includes a protrusion 51 extended from one end or inner end thereof and having a length or width smaller than that of the insert panels 50, to form a narrower protrusion 51 and to form one or more shoulders 52 between the insert panel 50 and the protrusion 51 respectively.

The protrusions 51 of the insert panels 50 may be engaged into the narrower slots 25 of the posts 21, and the posts 21 may be engaged with the shoulders 52 of the insert panels 50, such that the insert panels 50 may be solidly engaged into and secured to or anchored to the posts 21 respectively. Each of the insert panels 50 includes a screw hole 53 formed therein.

It is preferable that the insert panels 50 include a length no greater than, but preferably equals to the width or thickness of the posts 21, to allow the insert panels 50 to be completely engaged into the posts 21, and to prevent the insert panels 50 from being extended out of the posts 21, and also to prevent the insert panels 50 from being disengaged from the posts 21.

Each of the corner couplers 60 includes two extensions 61, 62 extended from such as the X-axis and the Y-axis thereof, and perpendicular to each other, for engaging into the open ends 31, 41 of the beams 30, 40 respectively, and for securing to the beams 30, 40 with such as fasteners 63, and thus for securing the beams 30, 40 together.

Each of the corner couplers 60 further includes an additional extension 64 extended from such as the Z-axis and also perpendicular to the other extensions 61, 62, for engaging into the open end portions 23, 24 of the posts 21 respectively, and each includes an orifice 65 formed therein, and formed through the additional extension 64, for aligning with the screw holes 53 of the insert panels 50 respectively.

A number of bolts or fasteners 66 may be engaged into the orifices 65 of the corner couplers 60, and may be threaded with the screw holes 53 of the insert panels 50 respectively, in order to solidly secure the corner couplers 60 and thus the beams 30, 40 to the posts 21, and so as to form a substantially cubic or parallelepiped structure. It is preferable that the extensions 64 of the corner couplers 60 are contacted or engaged with the insert panels 50 respectively, to allow the corner couplers 60 to be solidly secured to the posts 21, and to prevent the corner couplers 60 from being tilted relative to the posts 21.

Figure 4:
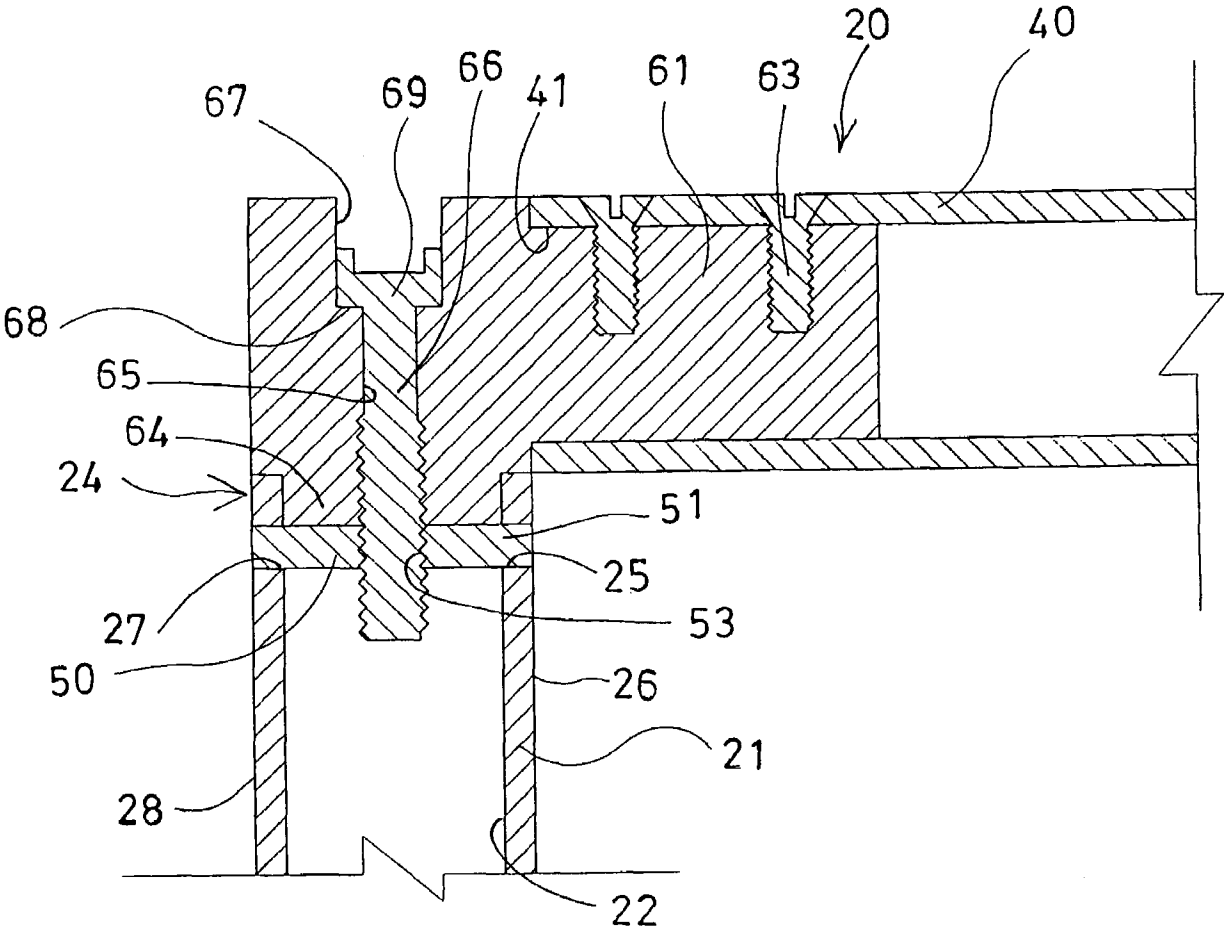
FIG. 4 is a partial cross sectional view of the container device, taken along lines 4-4 of FIG. 1.

As best shown in FIG. 4, it is preferable that each of the corner couplers 60 includes an enlarged opening 67 formed in an upper or outer portion thereof and communicating with the orifices 65 thereof, to form or define a peripheral shoulder 68 therein, and to form a stepped hole in the corner coupler 60, and to receive or anchor an enlarged head 69 of the fastener 66 therein, and thus to allow the fasteners 66 to be engaged into and protected by the corner coupler 60.

The engagements of the extensions 61, 62, 64 of the corner coupler 60 into the open end portions 31, 41, 23, 24 of the beams 30, 40 and of the posts 21, and the engagements of the fasteners 66 with the corner couplers 60 and the insert panels 50 may solidly couple the beams 30, 40 and the posts 21 together, and may solidly sustain the beams 30, 40 and the posts 21 in the cubic or parallelepiped structure, and may thus prevent the container device 10 from being collapsed.

Figure 5:
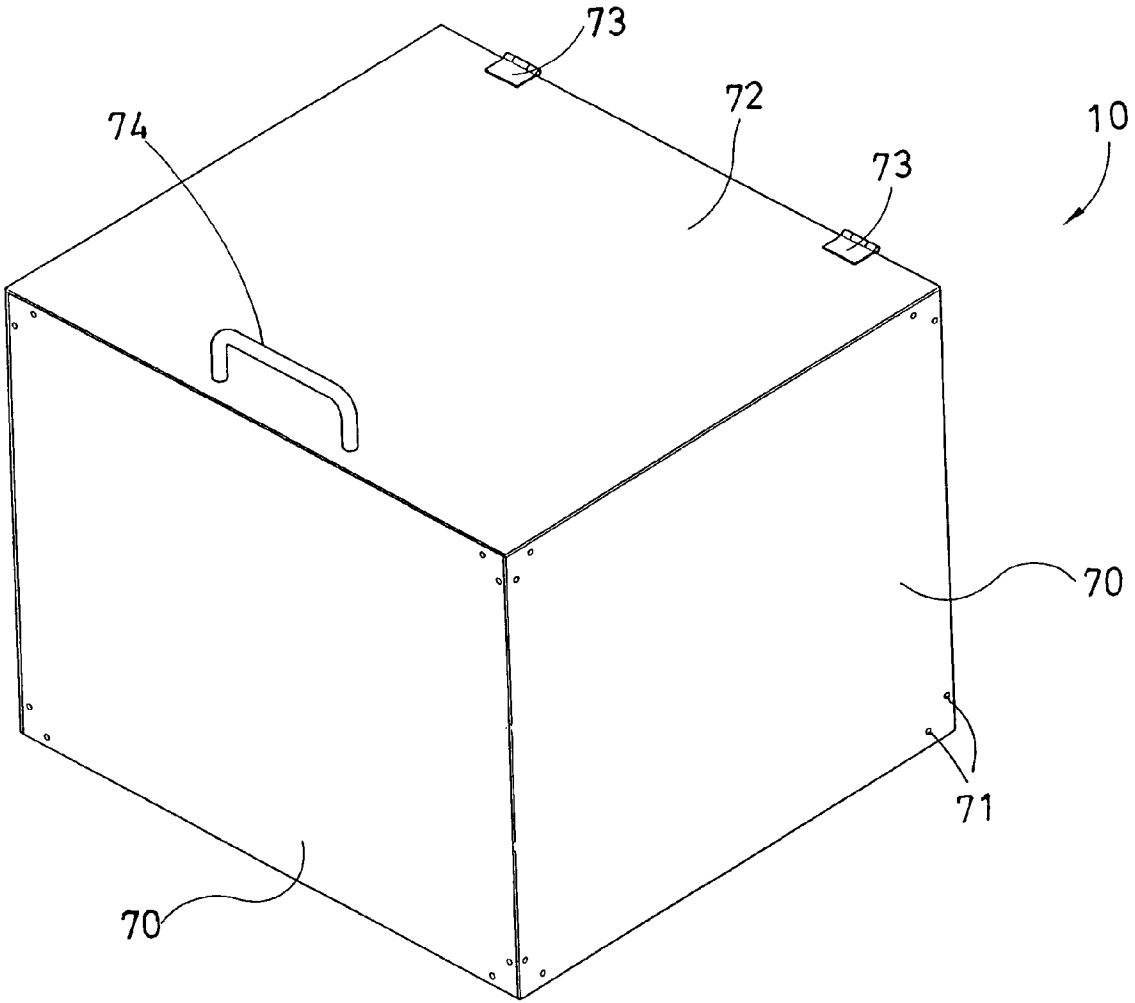
FIG. 5 is a perspective view illustrating the other arrangement of the container device.

A number of cover or outer plates 70 may be attached or secured onto the outer peripheral portion and the bottom portion of the skeleton 20 with such as fasteners 71, or by welding processes, to enclose the skeleton 20, and to form the container device 10 (FIG. 5). The outer plates 70 may include a solid structure having no apertures or orifices formed therein (FIGS. 1, 2, 5), or may be a netting structure having a number of apertures or orifices formed therein (FIG. 6).

A cover 72 may be pivotally or rotatably attached to the upper portion or either of the side portions of the skeleton 20 with such as joints or hinges 73, and includes a handle 74 for opening and closing or operating the cover 72. Similarly, the cover 72 may also include a solid structure having no apertures or orifices formed therein (FIGS. 1, 2, 5), or may be a netting structure having a number of apertures or orifices formed therein (FIG. 6).

Figure 6:
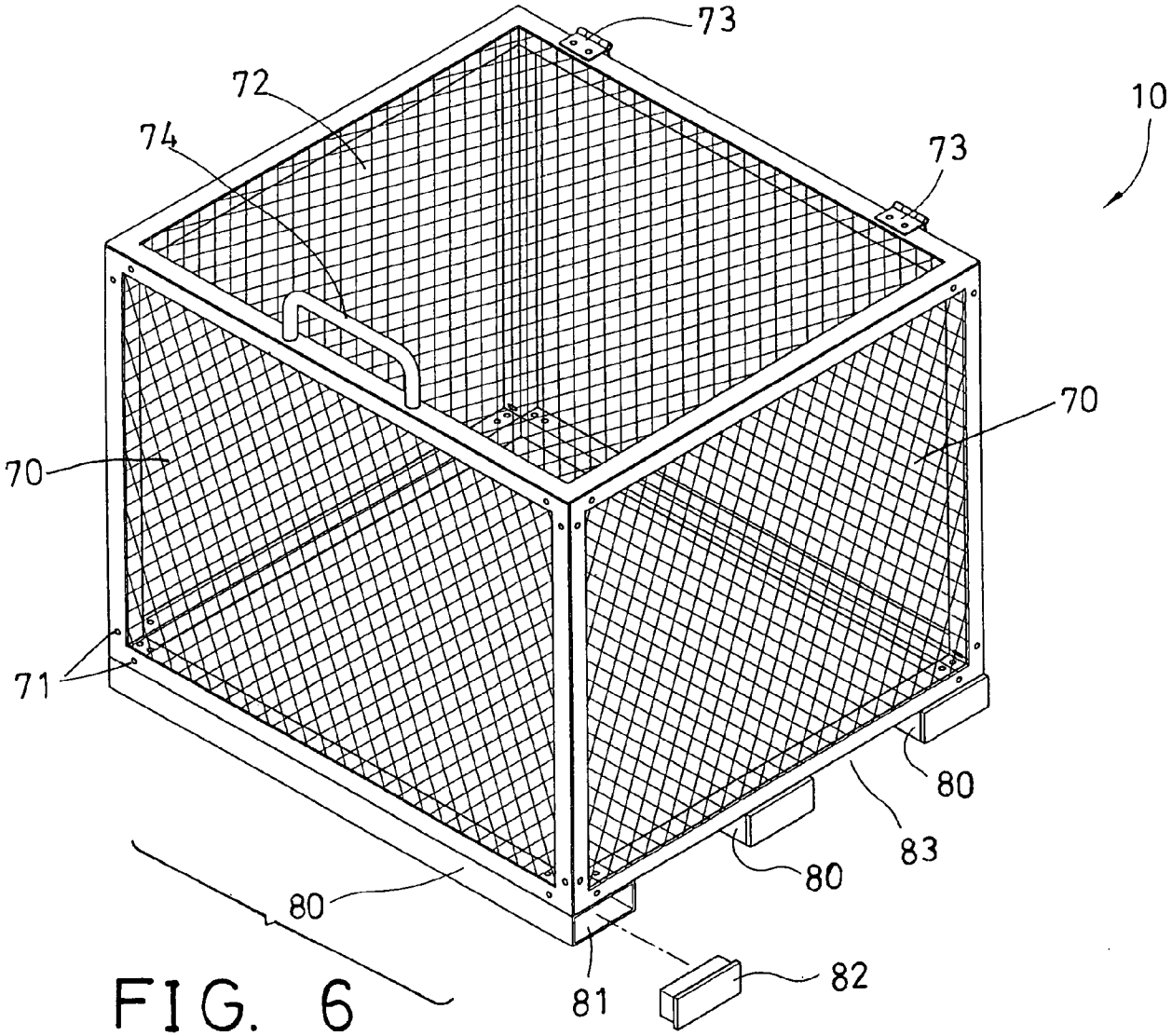
FIG. 6 is a perspective view similar to FIGS. 1, 5, illustrating a further arrangement of the container device.

As shown in FIGS. 1 and 6, the container device 10 may further include one or more, such as three support runners 80 extended from or attached to bottom thereof, and each having one or two open ends 81 enclosable by caps 82, in order to form or define one or more spaces 83 between the support runners 80, and for receiving or engaging with forks of fork lifts (not shown).

It is to be noted that the corner couplers 60 may be disengaged from the posts 21 and the beams 30, 40, such that the container device 10 may be folded or disassembled or dismantled to a compact storing configuration that is excellent for transportation and storing purposes. The engagements of the extensions 61, 62, 64 of the corner coupler 60 into the beams 30, 40 and of the posts 21 may solidly couple the beams 30, 40 and the posts 21 together.

Accordingly, the container device in accordance with the present invention includes a number of sustaining corner members to reinforce the corner areas of the container device and to prevent the container device from collapsing, and including a structure which may be disassemble to a compact storing configuration that is excellent for transportation and storing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A container device comprising:

a skeleton including four vertical posts to be disposed in four corner areas of said container device, each of said posts including two open end portions, and including a first side having a slot formed in each of said end portions thereof, and a second side having a groove formed in each of said end portions thereof and aligned with said slot thereof, four lateral lower beams and four lateral upper beams to be disposed and secured between said end portions of said posts respectively, and each including two open ends formed therein, a plurality of corner couplers disposed in said end portions of said posts respectively, and each including three extensions extended from X-axis, Y-axis and Z-axis thereof and perpendicular to each other, for engaging into said open ends of said beams and said open end portions of said posts respectively, each of said corner couplers including an orifice formed therein, a plurality of insert panels engaged into said end portions of said posts via said grooves of said posts respectively, and each including a screw hole formed therein and aligned with said orifice of said corner coupler respectively, and a plurality of fasteners engaged into said orifices of said corner couplers, and threaded with said screw holes of said insert panels respectively, to secure said corner couplers and said beams and said posts together, and to form a parallelepiped container structure.

2. The container device as claimed in claim 1, wherein said grooves of said posts include a width greater than that of said slots of said posts, and said insert panels each includes a protrusion extended therefrom to engage into said narrower slots of said posts and to allow said insert panels to be solidly engaged in said posts.

3. The container device as claimed in claim 2, wherein said protrusions each includes a width smaller than that of said insert panels, to form at least one shoulder in said insert panel, and to engage with said posts.

4. The container device as claimed in claim 1, wherein said insert panels include a length no greater than a thickness of said posts, to prevent said insert panels from being extended out of said posts.

5. The container device as claimed in claim 1, wherein said corner couplers each includes an enlarged opening formed in an outer portion thereof and communicating with said orifices thereof, to define a peripheral shoulder therein, and said fasteners each includes an enlarged head provided thereon and engaged with said peripheral shoulder of said corner coupler, to allow said fasteners to be engaged into and protected by said corner couplers.

6. The container device as claimed in claim 1 further comprising a plurality of outer plates attached to outer peripheral portion and bottom portion of said skeleton.

7. The container device as claimed in claim 1 further comprising a cover pivotally attached to said skeleton with hinges, and including a handle for operating said cover.

8. The container device as claimed in claim 1 further comprising at least two support runners attached to bottom thereof, to form at least one space between said at least two support runners, and for receiving forks of fork lifts.

9. The container device as claimed in claim 8, wherein said support runners each includes two open ends, and two caps to enclose said open ends of said support runners.

* * * * *